US006441566B2

(12) United States Patent
Shimizu et al.

(10) Patent No.: US 6,441,566 B2
(45) Date of Patent: Aug. 27, 2002

(54) COLOR CATHODE RAY TUBE AND COLOR PICTURE TUBE APPARATUS HAVING THE SAME

(75) Inventors: Norio Shimizu, Fukaya; Masaaki Ogura; Masatsugu Inoue, both of Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/808,167

(22) Filed: Mar. 15, 2001

(30) Foreign Application Priority Data

Mar. 24, 2000 (JP) ..... 2000-085255

(51) Int. Cl.[7] ..... H01J 29/51

(52) U.S. Cl. ..... 315/368.15; 315/382.1; 313/402; 313/408

(58) Field of Search ..... 315/15, 368.15, 315/382, 382.1, 376; 313/402, 403, 408, 477 R

(56) References Cited

U.S. PATENT DOCUMENTS 4,677,339 A 6/1987 Inoue et al. ..... 313/402
5,592,044 A * 1/1997 Ohtake et al. ..... 313/402
5,830,373 A * 11/1998 Ohtake et al. ..... 216/12
6,066,914 A 5/2000 Shimizu et al. ..... 313/477 R
6,133,682 A * 10/2000 Murai et al. ..... 313/403

FOREIGN PATENT DOCUMENTS

JP 11-086751 3/1999

* cited by examiner

*Primary Examiner*—Haissa Philogene
(74) *Attorney, Agent, or Firm*—Oblon, Spivak, McClelland, Maier & Neustadt, P.C.

(57) ABSTRACT

The thickness of a face panel is greater at a peripheral edge portion than at a center portion. At the inner surface of the face panel, a curvature radius in a short axis direction on a long axis is set to decrease from the center of the face panel toward a long axis end and, with L representing a distance from the center of the face panel to the long axis end, has a minimal value at a position spaced from the center of the face panel more toward the long axis end than L/2. A phosphor screen on the face panel has phosphor layers and non-emitting black layers and a percentage of the non-emitting black layers per unit area at least in the neighborhood of a diagonal axis end of the face panel is equal to or smaller than that at the center portion of the face panel.

16 Claims, 8 Drawing Sheets

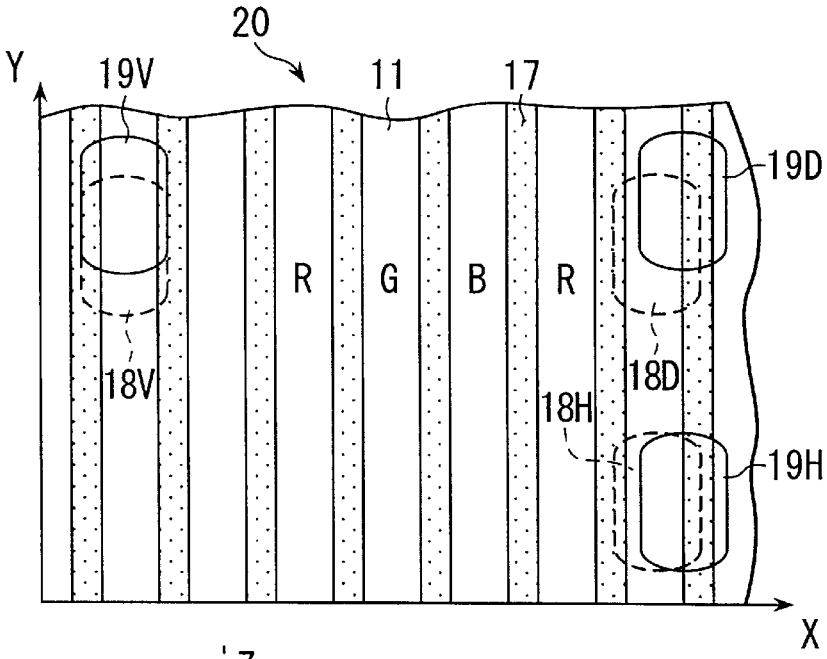
FIG. 3
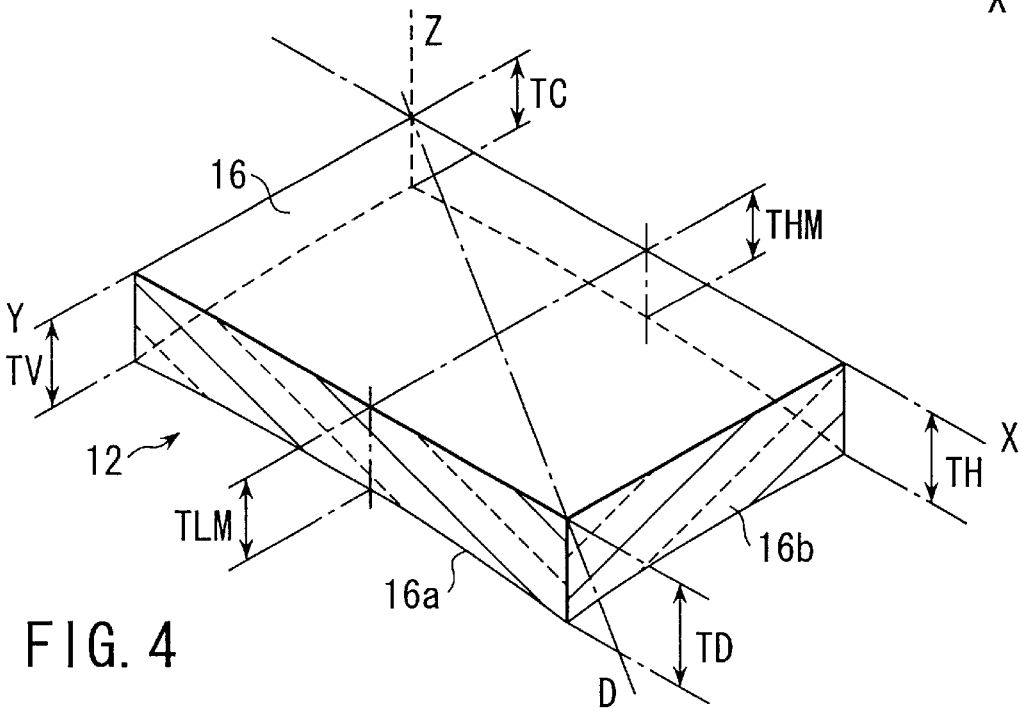
FIG. 4
| TV, TH<br>TD | 1.6TC<br>2.0TC | 1.8TC<br>2.25TC | 2.0TC<br>2.5TC | 2.2TC<br>2.75TC |
|---|---|---|---|---|
| BLACK UNIFORMITY | ○ | ○ | △ | × |
| BRIGHTNESS UNIFORMITY | ○ | ○ | ○ | △ |
FIG. 5

THICKNESS DISTRIBUTION OF PANEL'S EFFECTIVE SECTION

| DISTANCE (mm) FROM LONG AXIS IN SHORT AXIS DIRECTION | | | | | |
|---|---|---|---|---|---|
| 179.4 | 20.56 | 20.67 | 21.24 | 22.57 | 24.72 |
| 120 | 15.87 | 15.95 | 16.54 | 18.24 | 21.96 |
| 60 | 13.32 | 13.35 | 13.81 | 15.63 | 20.39 |
| 0 | 12.50 | 12.50 | 12.88 | 14.74 | 19.88 |
| | 0.0 | 60.00 | 120.0 | 180.0 | 239.2 |

DISTANCE (mm) FROM SHORT AXIS ALONG LONG AXIS DIRECTION

| DISTANCE FROM SHORT AXIS (mm) | 0.0 | 60.0 | 120.0 | 180.0 | 239.2 |
|---|---|---|---|---|---|
| THICKNESS DIFFERENCE (mm) | 8.06 | 8.17 | 8.36 | 7.82 | 4.84 |

| INNER SURFACE SHAPE OF PANEL | MOVEMENT AMOUNT (μm) | RATIO TO PRIOR ART |
|---|---|---|
| PRESENT EMBODIMENT (DIAGONAL R3000) | 92 | 97% |
| PRIOR ART (SPHERICAL SURFACE R3000) | 173 | 182% |
| PRIOR ART (DIAGONAL R1550) | 95 | 100% |
FIG. 12
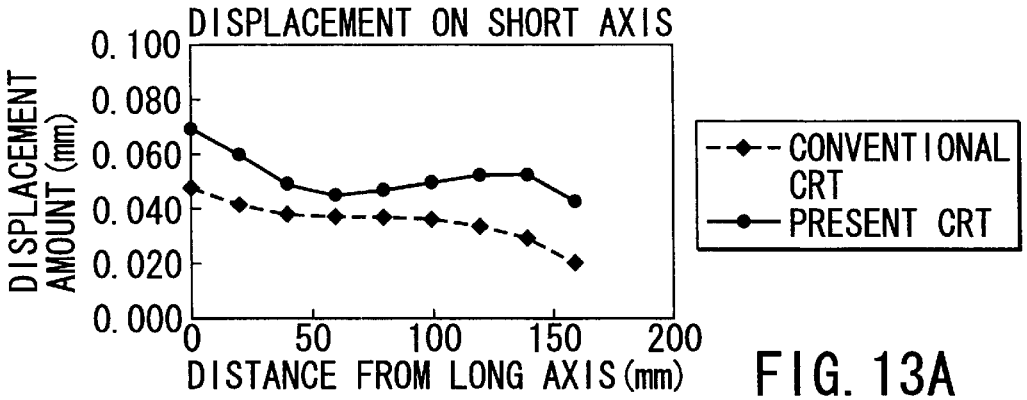
FIG. 13A
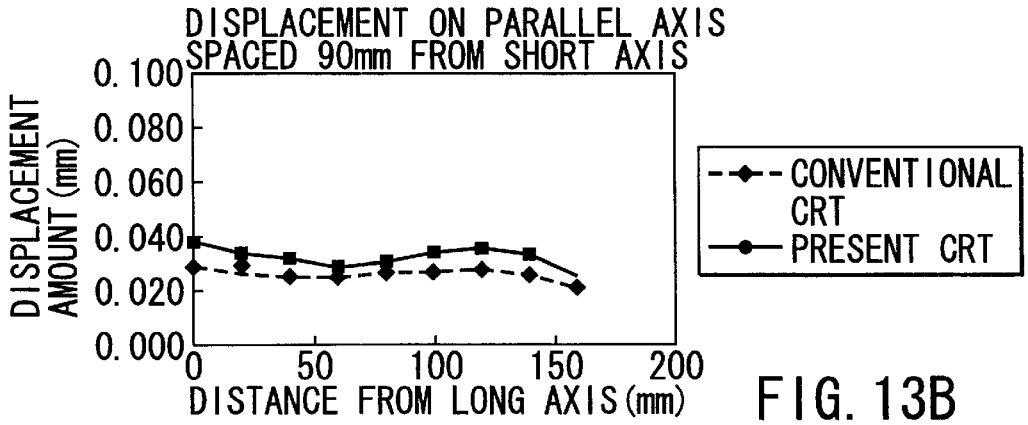
FIG. 13B
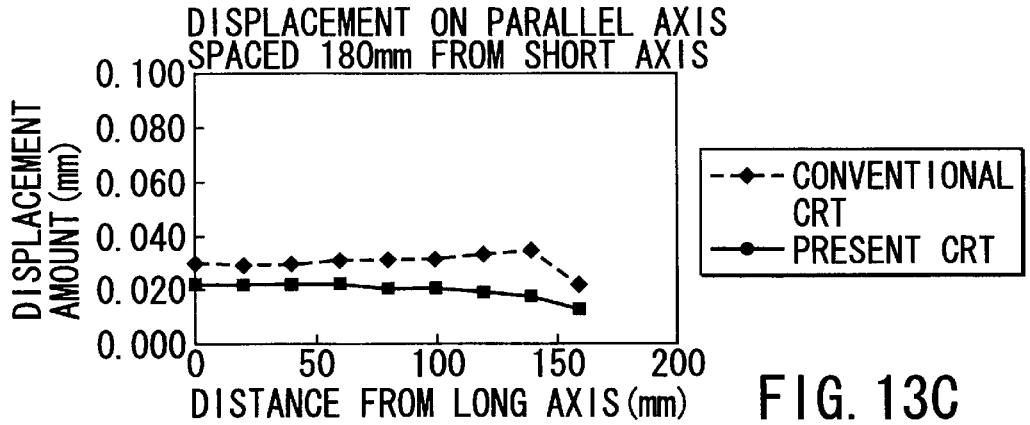
FIG. 13C

COLOR CATHODE RAY TUBE AND COLOR PICTURE TUBE APPARATUS HAVING THE SAME

CROSS-REFERENCE TO RELATED APPLICATIONS

This application is based upon and claims the benefit of priority from the prior Japanese Patent Application No. 2000-085255, filed Mar. 24, 2000, the entire contents of which are incorporated herein by reference.

BACKGROUND OF THE INVENTION

The present invention relates to a color cathode ray tube equipped with a shadow mask and to a color picture tube apparatus having the same.

In general, a color cathode ray tube includes a vacuum envelope which has a substantially rectangular panel and a funnel. The panel has a rectangular effective section constituting a curved surface and a skirt section at a peripheral edge of the effective section. The funnel is fixed to the skirt section. A phosphor screen is formed on the inner surface of the effective section and has three color phosphor layers and non-emitting black layers. Further, a shadow mask is arranged inside the panel and opposite to the phosphor screen. The shadow mask has a substantially rectangular mask body of a curved surface with a large number of electron beam passage apertures formed therein and a substantially rectangular mask frame supporting the peripheral edge of the mask body.

An election gun for emitting three electron beams is arranged in a neck of the funnel. The three electron beams emitted from the electron gun are deflected under magnetic field of a deflection device, mounted on the outer side of the funnel section, and horizontally/vertically scan the phosphor screen through the shadow mask, thereby displaying a color image.

In general, in order to display an image of no color drift on the phosphor screen of the color cathode ray tube, the electron beams passed through the electron beam passage apertures of the shadow mask need be landed precisely onto the three color phosphor layers of the phosphor screen. To this end, it is necessary to precisely hold a distance (q value) between the panel and the shadow mask.

In recent years, in order to improve the visibility of the color cathode ray tube and achieve a lower glaring from outer light, it is required that the curvature radius be enlarged to make the outer surface of the panel near-flat. Together with this, it is required that the curvature radius of the panel's inner surface be enlarged even from the standpoint of visibility. Further, in the case where a proper beam landing is to be achieved on the panel's inner surface, it is necessary to enlarge the curvature radius of the mask body where electron beam passage apertures are formed.

If, however, the curvature radius of the mask body is enlarged, then the strength of the curved surface is lowered, thus causing a deformation, etc., of the shadow mask during a manufacturing process and largely degrading the color purity of a color cathode ray tube manufactured.

In the shadow mask type color cathode ray tube, from the standpoint of an operation principle, electron beams reaching the phosphor screen past the electron beam passage apertures in the shadow mask are below ⅓ of a whole electron beam amount emitted from the electron gun. Remaining electron beams collide against the shadow mask and are converted to a heat energy to heat the shadow mask.

As a result, the shadow mask is thermally expanded toward the phosphor screen side, there occurring a "doming".

If, due to the doming, a space between the phosphor screen and the shadow mask exceeds an allowable range, the electron beams are landed imprecisely on the phosphor layers and the color purity is degraded. In particular when a high brightness image pattern is locally displayed, a local doming occurs at the shadow mask and, in a shorter period of time, more imprecise beam landing occurs locally. In the case where the curvature radius of the mask body is enlarged, the above-mentioned local doming becomes prominent.

According to a cathode ray tube disclosed in U.S. Pat. No. 6,025,676, the inner surface of the panel and the mask body are formed in a semi-cylindrical curved shape wherein the radius of curvature in a direction along a long axis is set to be infinity and the radius of curvature in a direction along a short axis is set to be a certain value. By doing so, it is possible to substantially solve a mask doming problem and a mask curvature strength problem.

In the case of the above-mentioned structure, an outer light reflection between the inner surface of the panel and the phosphor screen adversely acts to a greater extent, thus lowering an image contract. This problem is alleviated by providing a selective light-pervious filter between the inner surface of the panel and the phosphor screen. If this is the case, then a high manufacturing cost is involved and a new manufacturing equipment if necessary.

Further, in the case where the contrast is to be improved without providing a filter, a panel has to be formed using glass having a transmittance of about 50%. In this case, the brightness is lower at the peripheral edge portion than at the center portion of the panel, so that the brightness uniformity is degraded.

BRIEF SUMMARY OF THE INVENTION

The present invention has been contrived in consideration of the above circumstances and its object is to provide a color cathode ray tube which ensures a better external light reflection level on the inner surface of a panel and can improve color purity, and a color picture tube apparatus equipped with the color cathode ray tube.

In order to achieve the above-mentioned object, a color cathode ray tube according to the present invention comprises a vacuum envelope quipped with a substantially rectangular face panel having a substantially flat outer surface and an inner surface with a phosphor screen formed thereon, long and short axis orthogonal to a tube axis and orthogonal to each other, a pair of long sides substantially parallel to the long axis and a pair of short sides substantially parallel to the short axis; a shadow mask arranged in the vacuum envelope to face the phosphor screen; and an electron gun provided in the vacuum envelope, for emitting electron beams onto the phosphor screen, wherein the thickness of the face panel is so formed as to be greater at a peripheral edge portion than at a center portion of the f ace panel and, at the inner surface of the face panel, a curvature radius along a short axis direction on the long axis has a minimal value at a position spaced from the center of the face panel more toward a long axis end side than L/2, provided that a distance from the center of the face panel to a long axis end is L, and the face panel satisfies the following relations $$TD<2.5TC$$

$$TV<2.0TC$$

$TH<2.0TC$ where

TC: the thickness of the face panel at a center portion

TD: the thickness of the face panel at a diagonal effective dimension end;

TV: The thickness of the face panel at a short axis effective dimension end; and TH: the thickness of the face panel at a long axis effective dimension end.

Further, according to a color cathode ray tube of the present invention, at an area between the short axis of the face panel and the short side of the face panel, a difference between the thickness on the long axis and the thickness on the long side at a cross-section parallel to the short axis has a maximal value at a position spaced from the center of the face panel more toward the short side than L/2.

According to the color cathode ray tube of the present invention, at the inner surface of the face panel, the curvature radius in a long axis direction on the long axis has a minimal value at a position spaced from the center of the face panel more toward a long axis end side than L/2.

According to the color cathode ray tube of the present invention, at least at an area spaced from the center of the face panel L/2 toward the long axis end side, the curvature radius in a direction parallel to the short axis of the inner surface of the face panel is so set as to decrease from on the long axis toward the long side.

According to the color cathode ray tube of the present invention, the mask body of the shadow mask is also so formed as to have substantially the same shape as that of the inner surface of the face panel.

According to the thus structured color cathode ray tube and a color picture tube apparatus equipped with this color cathode ray tube, the radius of curvatures of the inner and outer surfaces of the face panel and mask body are set under proper conditions and, by doing so, it is possible to provide a better outer light reflection level on the inner surface of the face panel while ensuring a better visibility and to alleviate a lowering in color purity of the color cathode ray tube resulting from a doming of the shadow mask at a time of operating a color cathode ray tube and a lowering, etc., in color purity resulting from an imprecise beam landing caused by the deformation of the mask body at a manufacturing process.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3 is a plan view, partly enlarged, showing a phosphor screen of the above-mentioned color cathode ray tube;

FIG. 4 is a perspective view showing one part of the face panel as a model;

FIG. 5 is a view showing the results of evaluation on the black uniformity and brightness uniformity of an image screen corresponding to the thickness of the peripheral edge portion of the face panel relative to the center portion of the face panel;

FIG. 12 is a view showing a comparison between the above-mentioned color cathode ray tube and a conventional counterpart in amounts of displacement of electron beam spots resulting from the doming of the shadow mask; and FIGS. 13A to 13C show a modified mask body of the shadow mask of the color cathode ray tube as compared with a conventional counterpart.

DETAILED DESCRIPTION OF THE INVENTION

With reference to t he drawings, a detailed explanation will be made below about a present embodiment applied to a color picture tube apparatus equipped with a color cathode ray tube (CRT) having an aspect ratio of 4:3 and a diagonal dimension of 60 cm.

Figure 1:
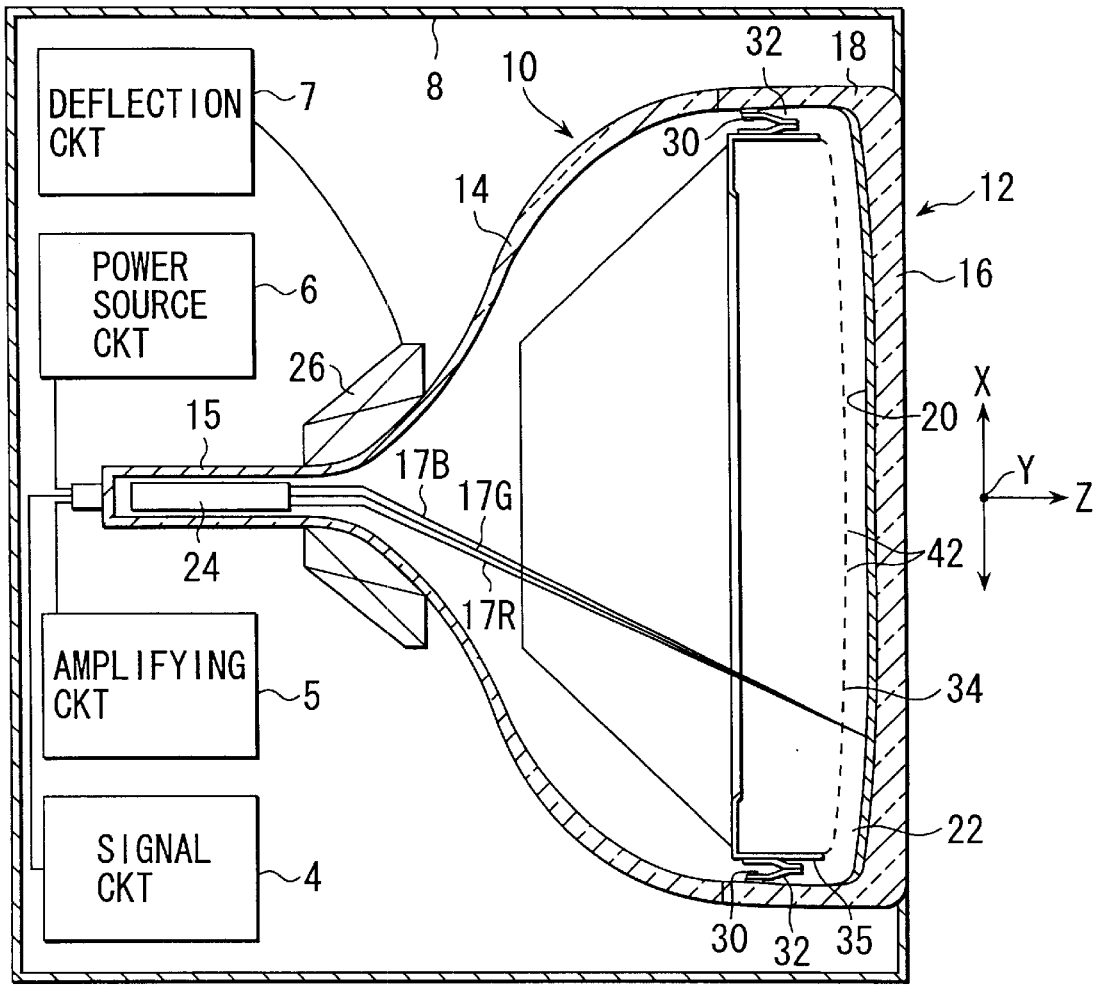
FIG. 1 is a cross-sectional view showing a color picture tube apparatus according to an embodiment of the present invention.
Figure 2:
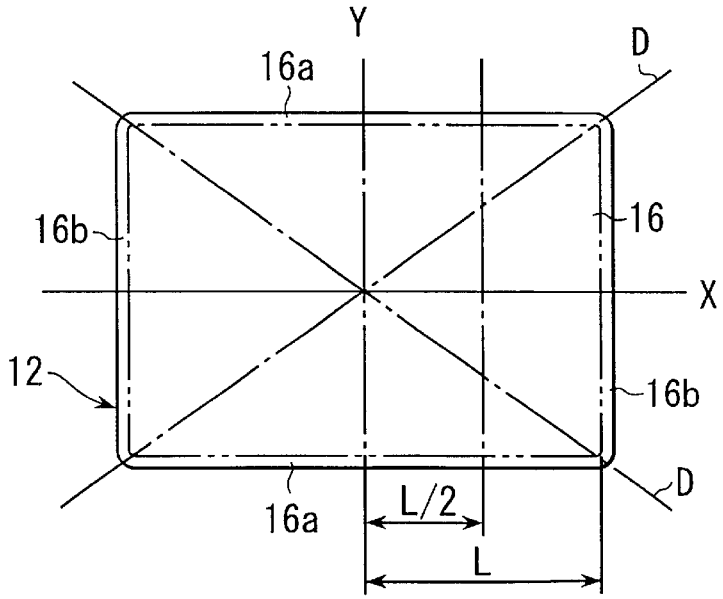
FIG. 2 is a plan view showing a face panel of a color cathode ray tube in the above-mentioned color picture tube apparatus.

As shown in FIGS. 1 and 2, the color picture tube apparatus has a substantially rectangular housing 8 in which the color CRT is held in place. The color CRT has a vacuum envelope 10 including a face panel 12 and a funnel 14. The face panel 12 has a substantially rectangular effective section 16 of a substantially flat outer surface and a skirt section 18 upright at a peripheral edge of the effective section. The face panel 12 has a long axis (X axis) orthogonal to the tube axis Z and a short axis (Y axis) orthogonal to the long axis and tube axis. The funnel 14 is joined to the skirt section 18. The face panel 12 is formed of glass having a transmittance of below 60%.

As shown in FIG. 3, a phosphor screen 20 has striped phosphor layers 11 of three colors emitting blue, green, red light and striped non-emitting black layers 17 formed on the inner surface of the effective section 16 of the face panel 12 with the black layer formed between the phosphor layers.

As shown in FIG. 1, shadow mask 22 is arranged in the vacuum envelope 10 at an inner side of the face panel 12. The shadow mask 22 is located opposite to the phosphor screen 20 and has a substantially rectangular mask body 34 with a larger number of electron beam passage apertures 42 formed therein and a substantially rectangular mask frame 35 supporting the peripheral edge of the mask body. The shadow mask 22 is detachably supported on the inner side of the face panel 12 by engaging a plurality of stud pins 30 projecting from the inner surface of the skirt section 18 of the face panel 12 with a plurality of corresponding elastic supports 32 attached to the mask frame 35. An electron gun 24 is arranged in a neck 15 of the funnel 14 and adapted to emit three electron beams 17B, 17G, and 17R.

A deflection device 26 is mounted on the outer circumference of the funnel 14 and a deflection circuit 7 is connected to the deflection device 26. A power source circuit 6 for driving the electron gun 24, amplifying circuit 5 and signal circuit 4 are connected to the electron gun 24. These circuits 4 to 7 constitute a drive circuit of the present invention.

In the color CRT, the three electron beams 17B, 17G and 17R emitted from the electron gun 24 are deflected under the magnetic field generated from the deflection device 26 to allow the phosphor screen 20 to be horizontally/vertically scanned with the electron beams through the shadow mask 22 and, by doing so, a color image is displayed.

In the above-mentioned color CRT, as shown in FIG. 4, the thickness of the effective section 16 of the face panel 12 is so formed as to be made greater at the peripheral edge portion than at the center portion. In the effective section 16, for example, let the thickness TC of the center portion to be set to 12.5 mm, the thickness TD of the effective dimension end of a diagonal axis D direction to 28.3 mm, the thickness TV of the effective dimension end of the short axis Y direction to 22.0 mm, and the thickness TH of the effective dimension end of the long axis X direction to 21.9 mm. Then the effective section 16 is set to be in the following relations:

$$TD=2.26TC$$

$$TV=1.76TC$$

$$TH=1.75TC$$

In the case where the thickness of the effective section 16 is made greater at the peripheral edge portion than at the center portion, the brightness at the peripheral edge portion of the image screen is lowered. Further in the case where the face panel 12 is formed of glass of a low transmittance of, for example, below 60% so as to reduce an outer light reflection level at an interface between the inner surface of the face panel 12 and the phosphor screen 20, it follows that, in the operative state of the color cathode ray tube, the brightness uniformity varies greatly between at the center portion and at the peripheral edge portion of the panel effective portion 16 and hence the brightness uniformity on the image screen is lowered.

FIG. 5 shows the results of evaluation on the black uniformity on the image screen at a non-operative time of the color CRT and on the brightness uniformity of the image screen at an operative time of the color CRT when the thickness of the peripheral edge portion of the effective section 16 is varied relative to the thickness of the center portion of the effective section 16 in the case where the transmittance of the center portion of the face panel 12 is 50% and a percentage (hereinafter refereed to as a BLK) occupied by the non-emitting black layer 17 per unit area at the center portion of the phosphor screen 20 is 45%. In FIG. 5, marks ○, Δ and X indicate "good", "slightly good" and "bad", respectively.

According to the present embodiment, from the results of evaluation, the thickness TC of the center portion, thickness TV of the short axis effective dimension end, thickness TH of the long axis effective dimension end, and thickness TD of the orthogonal effective dimension end are set in a range satisfying the following relations:

$$TD<2.5TC,\ TV<2.0TC,\ TH<2.0TC$$

It is to be noted that, since, at the diagonal axis effective end, the distance from the center of the effective section 16 is longer, a greater thickness can be set than those of the short axis and long axis effective ends.

Further, in order to reduce the degradation of the brightness of the peripheral edge portion relative to the center portion of the effective portion 16, the BLK of at least a diagonal effective end at the peripheral edge portion of the effective section 16 is set to be equal to, or smaller than, the BLK of the center portion. In the case where, in the present embodiment, the BLK of the center portion is set to be 45%, the BLK at the peripheral edge portion is 41% for the short axis effective dimension end, 51% for the long axis effective dimension end and 42% for the diagonal effective dimension end and, by doing so, the degradation of the brightness uniformity is reduced.

The outer surface of the effective section 16 of the face panel 12 has its curvature radius set to be greater than 10 m and is so formed as to be substantially flat. Further, the curvature radius of the inner surface of the effective section 16 is so set as to be described below. That is, as indicated by a solid line A–D in FIG. 6A and as shown in FIG. 6B, the curvature radius in the short axis direction on the short axis Y is about R2200 in the neighborhood of the center of the effective section 16 but it becomes gradually smaller toward the peripheral edge of the short axis direction and is about R1800 near an intermediate portion between the long axis X and the long side 16*a* and about R1000 at the outermost area of the effective section.

In the case where, as shown in FIG. 2, the distance from the center of the effective section 16 to the effective end of the long axis x is represented by L, the relation of the curvature radius in the Y direction of the short axis as set out above, that is, a relation of the center portion> intermediate portion > effective section's outermost portion, continues from the center of the effective section to an area apart from the center by the distance L/2 in the long axis x direction.

Figure 6A:
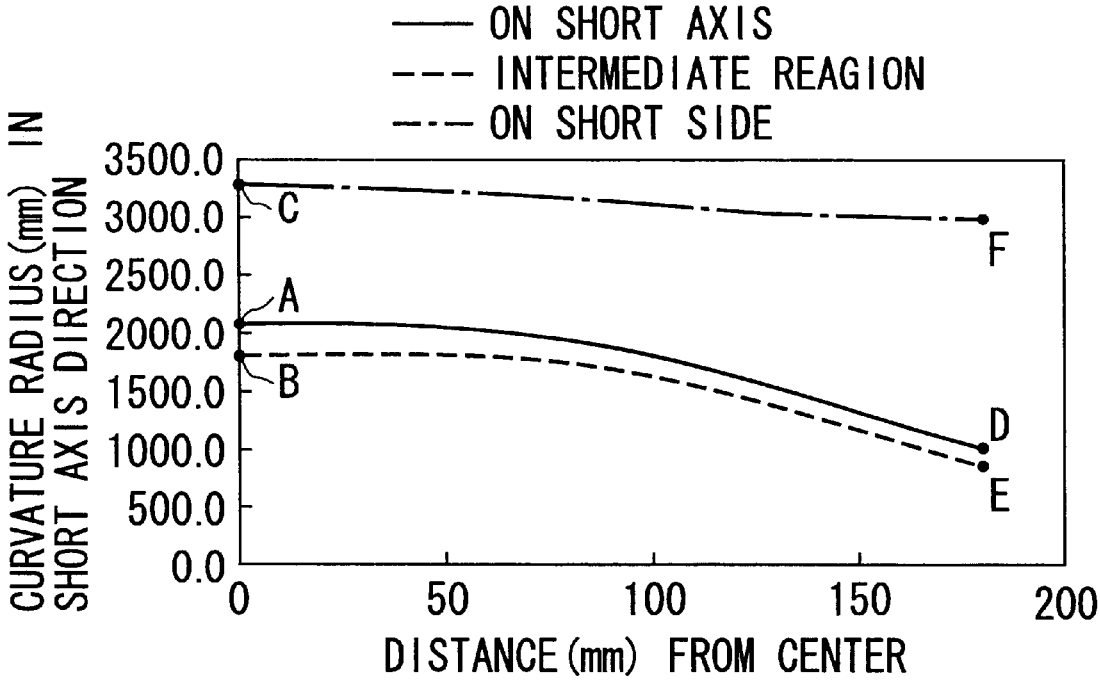
FIG. 6A is a view showing a curvature radius along a short axis direction of the inner surface of an effective section of the face panel.
Figure 6B:
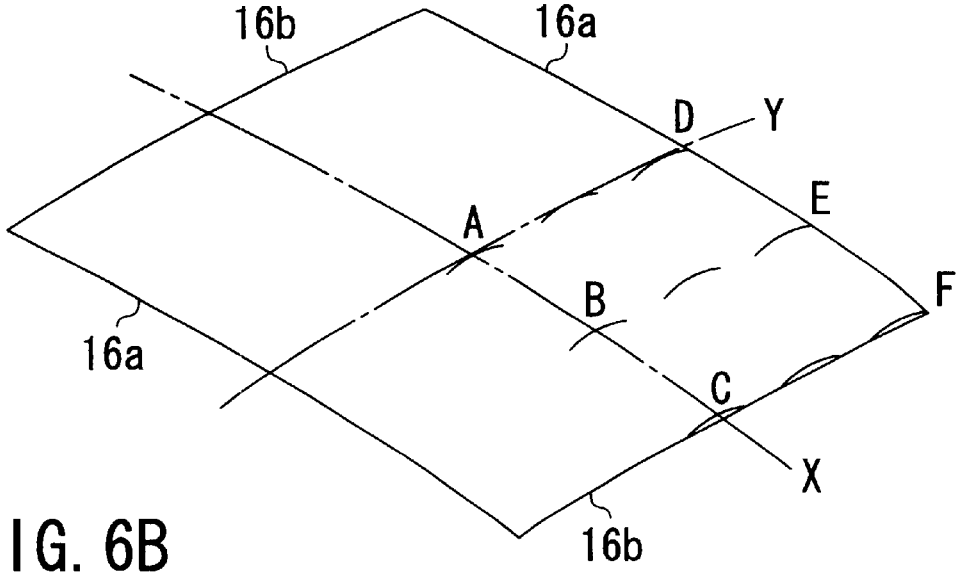
FIG. 6B is a perspective view showing the inner surface of the above-mentioned effective section as a model.

As indicated by a dot and dashed line C–F in FIG. 6A, at the short side 16*b*, the curvature radius in the Y direction of the short axis is about R3300 near the center portion, about R3200 near the intermediate portion and about R3000 at the effective section's outermost area and provides a substantially single curvature radius or a curvature radius represented by a function whose second-order component is above 80%. This is because, if there are more high-order components in the above-mentioned function, a waviness occurs on the inner surface of the effective section 16 and also on the effective area shape of the short side 16*b*.

Figure 7A:
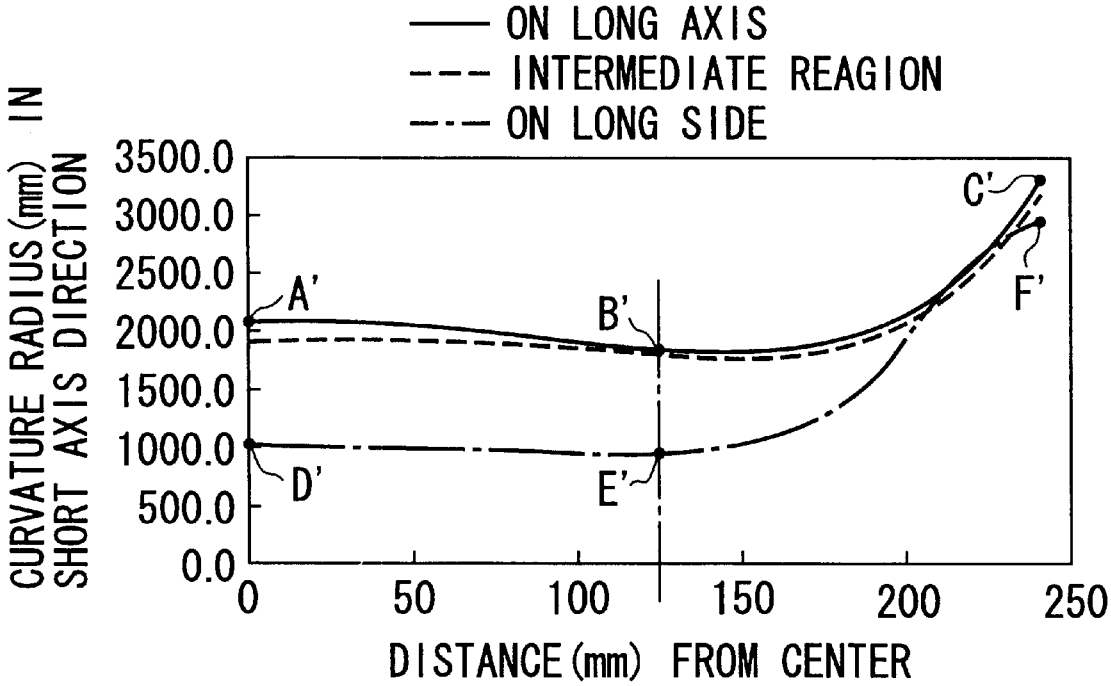
FIG. 7A is a view showing a curvature radius along a short axis direction on the inner surface of the effective section of the face panel.
Figure 7B:
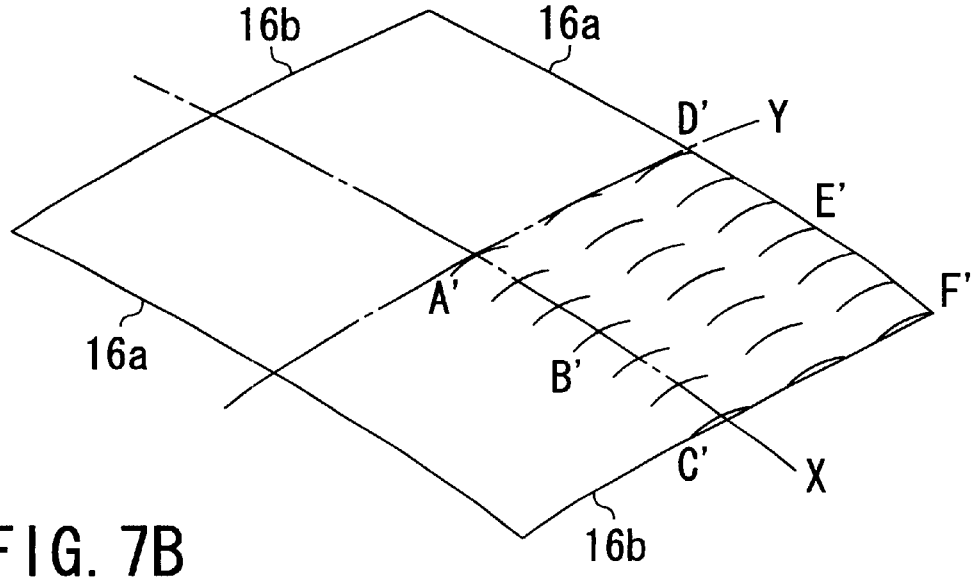
FIG. 7B is a perspective view showing the inner surface of the effective section as a model.

As indicated by the solid line A'–C' in FIG. 7A and as shown in FIG. 7B, the curvature radius in the short axis Y direction on the long axis X is set to be about R2200 at the center portion of the effective section 16, about R2000 at the intermediate portion and R3300 at the short side 16*b* portion. Further, this curvature radius takes a minimal value, that is, about R1800, near a position spaced 2L/3 from the center toward the long axis effective dimension end side. In this case, the curvature radius in the short axis direction on the long axis X has a minimal value at an area spaced from the center of the effective section 16 more toward the long axis effective end side than L/2.

Figure 8A:
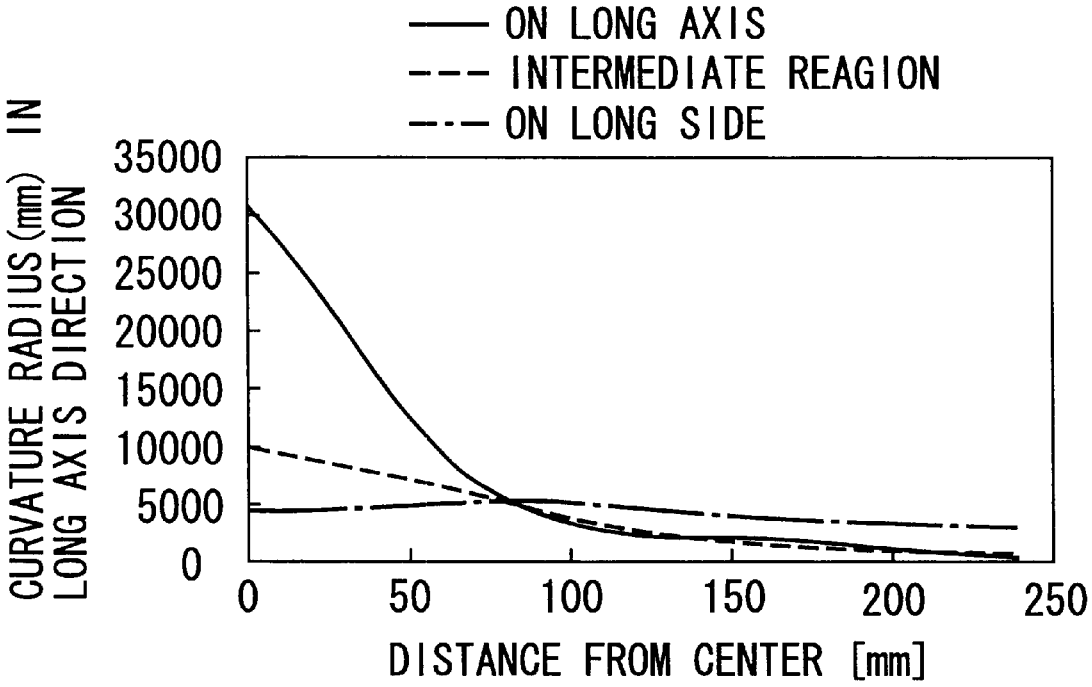
FIG. 8A is a view showing a curvature radius along a long axis direction on the inner surface of the effective section of the face panel.
Figure 8B:
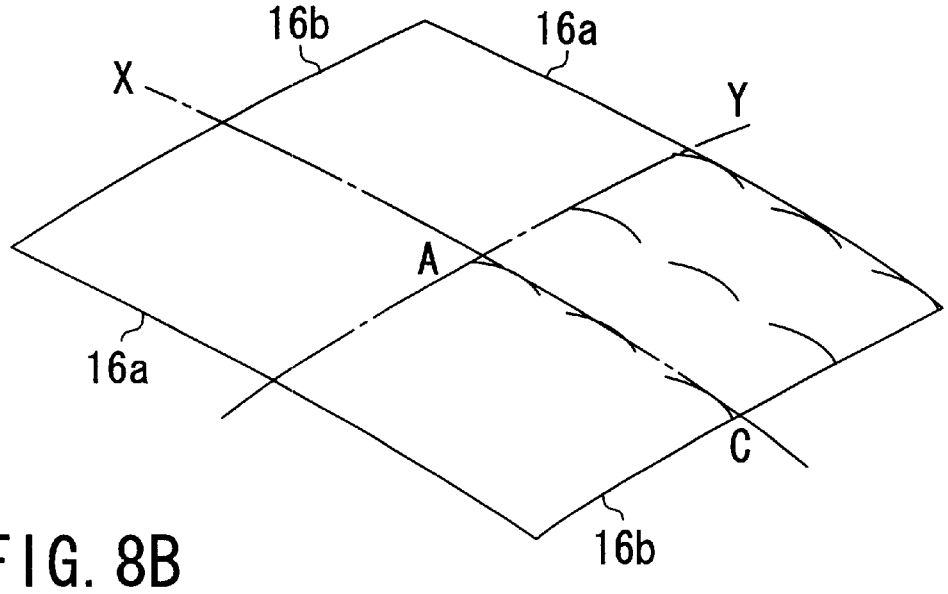
FIG. 8B is a perspective view showing the inner surface of the effective section as a model.

Further, as indicated by the solid line in FIG. 8A and as shown in FIG. 8B, the curvature radius in the long axis direction on the long axis X is about R30000 at the center portion of the effective section 16, about R2300 at the intermediate portion, and R330 at the outermost area of the effective section, that is, at the short side 16*b* and is so set as take a minimal value at a position spaced from the center of the effective section more toward the long axis effective end side than L/2.

Figures 9A, 9B, 9C:
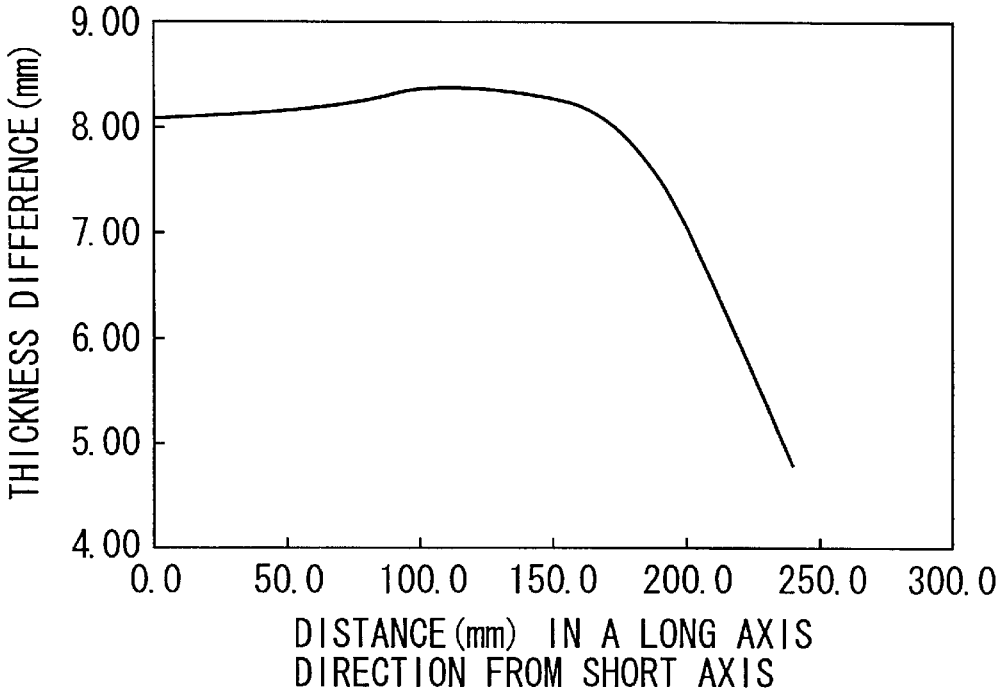
FIG. 9A is a table showing the thickness distribution of the effective section of the face panel.
FIG. 9B is a table showing the thickness difference of the effective section.
FIG. 9C is a graph showing the thickness difference of the effective section.

The thickness distribution of the effective section of the above-mentioned face panel 12 is as shown in FIG. 9A. If, as shown in FIG. 4, in the effective section 16, the thickness of the center portion is represented by TC, thickness of the effective dimension end of the diagonal axis D direction by TD, thickness of the effective dimension end of the short axis Y direction by TV, thickness of the effective dimension end of the long axis X direction by TH, thickness of the intermediate portion spaced a distance of 120 mm from the center along the long axis X by THM, and thickness of the intermediate portion 120 mm from the short axis Y along the long side 16*a* by TLM, then the effective section 16 of the face panel 12 is so formed as to satisfy the following relation:

$$(TD-TH)<(TV-TC)\leqq(TLM-THM)$$

That is, as shown in FIGS. 9B and 9C, upon the viewing of a difference between the thickness on the long axis X and the thickness on the long side 16*a* at each cross-section parallel to the short axis Y of the effective section 16, the thickness difference is maximal at an intermediate area between the short axis Y and the short side 16*b*.

Figure 10:
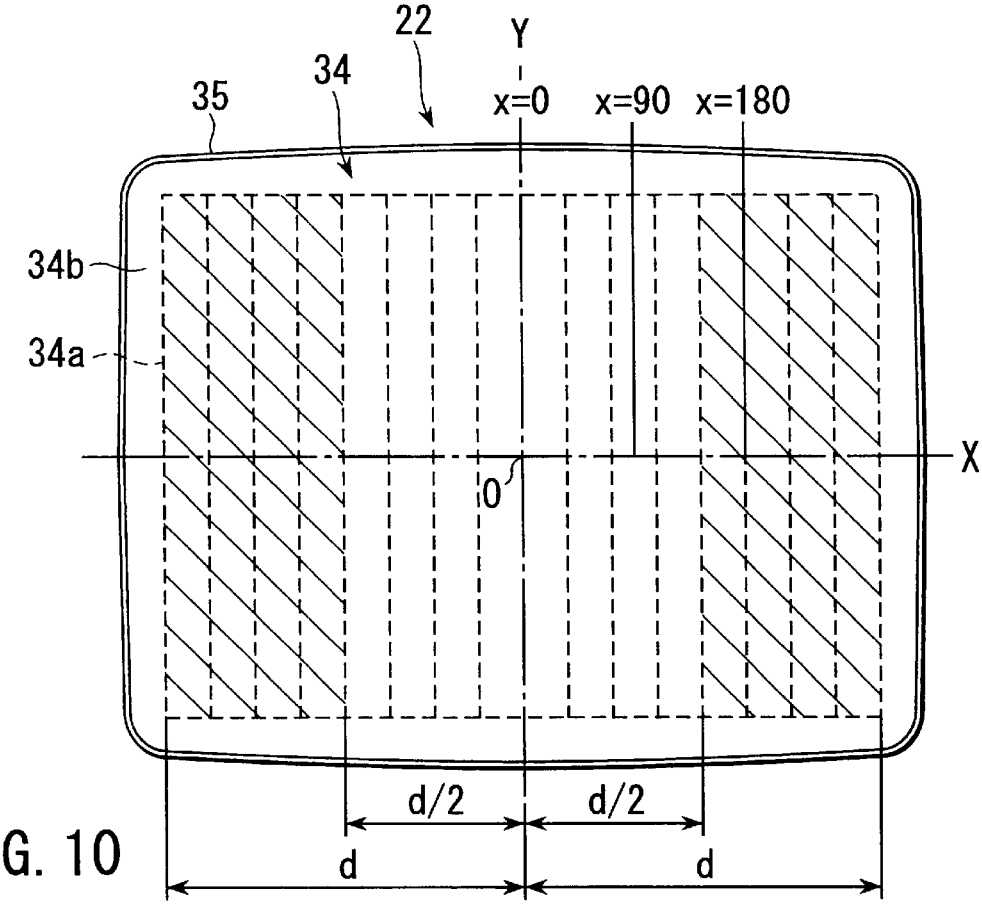
FIG. 10 is a plan view showing a shadow mask of the color cathode ray tube.

As shown in FIG. 10, on the other hand, the mask body 34 of the shadow mask 22 has a substantially rectangular effective section 34*a* having a large number of electron beam passage apertures and a non-aperture area 34*b* formed around the effective area and not having any passage apertures. And the effective section 34*a* is so formed as to have substantially the same shape as the inner surface of the effective section 16 of the face panel 12.

Figure 11:
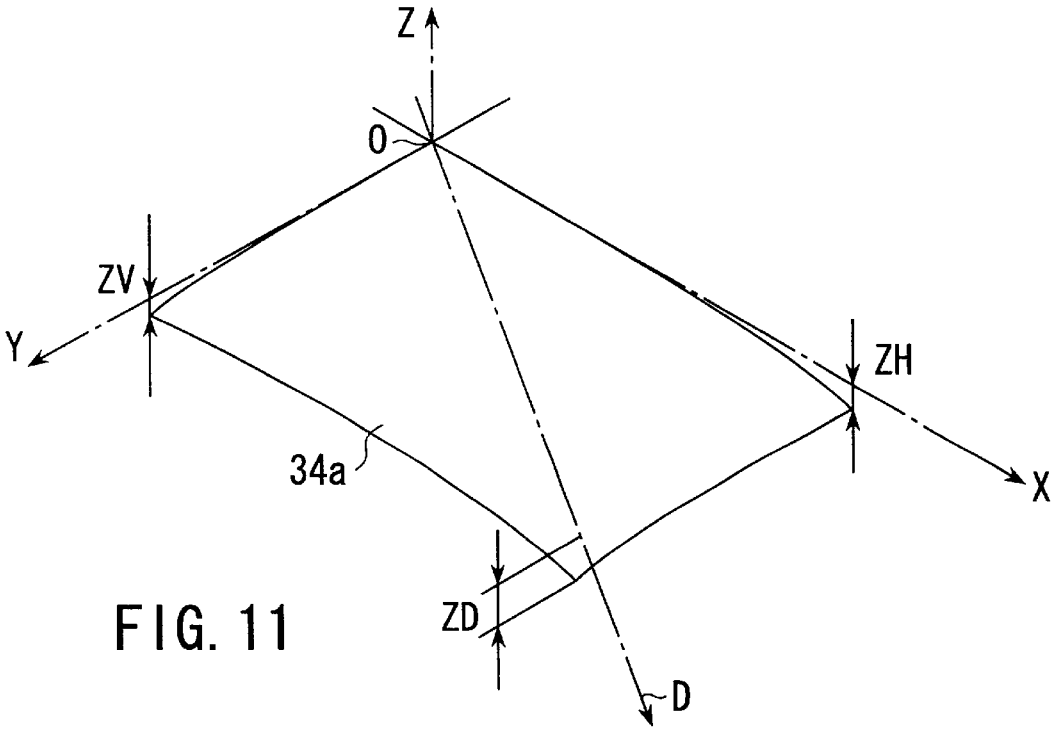
FIG. 11 is a perspective view showing one part of the shadow mask as a model.

As shown in FIGS. 10 and 11, the effective section 34*a* of the mask body 34 is so formed that a fall amount of each portion in the tube-axis Z direction relative to the height of the center O satisfies a relation of $$ZV<0.8ZD,\ ZH<0.8ZD$$

where ZD represents a fall amount at the diagonal axis D end; ZV, at the short axis Y end; and ZH, at the long axis X end. If, in the present embodiment, for example, ZD is set to be 13.0 mm, ZV to be 8.9 mm and ZH to be 8.8 mm, then ZV is set to be 0.68 ZD and ZH to be 0.68 ZD.

Further, the m ask body 34 is such that the curvature radius in the short axis direction on the long axis X becomes smaller from the center of the mask body toward the long axis end. The curvature radius has a minimal value at a position spaced from the center of the mask body more toward the long axis end side than d/2, where d represents a distance from the center O of the mask body to the long axis end. The curvature radius in the long axis direction on the long axis X has a minimal value at a position spaced from the center O of the mask body 34 more toward the long axis side than d/2. In an area going from the center O of the mask body by d/2toward the long axis end side, the curvature radius in a direction parallel to the short axis Y of the mask body 34 is so set as to decrease from on the long axis X toward the long side of the mask body.

FIG. 12 s hows a comparison between the color CRT according to the present embodiment and the conventional counterparts in an amount of movement of an electron beam spot resulting from the doming of the shadow mask. FIGS. 13A to 13C show a comparison between the color CRT of the present embodiment and the conventional counterpart on the results of simulation on the displacement amount of the mask body at a time of applying a load of about IG. FIG. 13A shows an amount of deformation at each position along the short axis Y of the mask body 34 shown in FIG. 10, FIG. 13B shows an amount of deformation at each position along an axis parallel to the short axis Y and spaced 90 mm from the short axis and, further, FIG. 13C shows an amount of deformation at each position parallel to the short axis Y and spaced 180 mm from the short axis.

As understood from FIG. 12, according to the color CRT of the present embodiment, by forming the inner surface of the faceplate 12 and mask body 34 as set out above, even if curvature radius of the inner surface of the effective section 16 and the mask body 34 are enlarged, the moving amount of the electron beam spot resulting from the doming of the shadow mask never becomes greater and substantially the same result as those of the conventional counterparts was obtained. As understood from FIGS. 13A to 13C, the displacement amount of the mask body 34 resulting from the application of the load, being somewhat lower on the short axis Y, is decreased at the peripheral edge portion of the mask body when compared with the conventional counterparts.

In the case where the mask body 34 is deformed, electron beam spots 18H, 18V and 18D formed on the phosphor screen 20 are displaced toward the peripheral edge of the phosphor screen as indicated by 19H, 19V and 19D in FIG. 3. Even if, therefore, any delicate deformation occurs in the mask body, the color purity is degraded on the long axis X or on the diagonal axis D as going toward the peripheral edge and, in comparison therewith, is not so considerably degraded near the short axis Y. According to the present embodiment, as set out above, the displacement amount of the mask body 34, though being somewhat not better on the short axis Y, is decreased at the peripheral edge portion of the mask body and it is possible to obtain a color purity above that of the conventional counterparts.

By setting the curvatures of the inner and outer surfaces of the mask body 34 and face panel 12 under proper conditions it is possible, according to the so structured color CRT and color picture tube apparatus equipped therewith, to obtain a better-quality outer light reflection level on the inner surface of the face panel 12 while ensuring a better visibility and to alleviate a lowering in the color purity of the color CRT resulting from the doming of the shadow mask at a time of operating the color CRT and a lowering, etc., in the color purity caused by no precise beam landing resulting from the deformation of the mask body produced at a manufacturing process.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

a vacuum envelope including a substantially rectangular face panel having a substantially flat outer surface and an inner surface with a phosphor screen formed thereon, short and long axes orthogonal to a tube axis and orthogonal to each other, a pair of long sides substantially parallel to the long axis and a pair of short sides substantially parallel to the short axis;

a shadow mask arranged within the vacuum envelope to face the phosphor screen; and an electron gun provided within the vacuum envelope, for emitting electron beams onto the phosphor screen through the shadow mask, wherein the thickness of the face panel is so formed as to be greater at a peripheral edge portion than at a center portion of the face panel, a curvature radius in the short axis direction on the long axis at the inner surface of the face panel has a minimal value at a position spaced from a center of the face panel more toward the long axis end side than L/2, provided that a distance from the center to the long axis end of the face panel is L, and the face panel satisfies the following relations:

$$TD<2.5TC$$

$$TV<2.0TC$$

$$TH<2.0TC$$

where

TC: the thickness of the face panel at the center portion;

TD: the thickness of the face panel at a diagonal axis effective dimension end;

TV: The thickness of the face panel at a short axis effective dimension end; and TH: the thickness of the face panel at a long axis effective dimension end.

2. A color cathode ray tube according to claim 1, wherein, at an area between the short axis and the short side of the face panel, a difference between the thickness on the long axis and that on the long side at a cross-section parallel to the short axis has a maximal value at a position spaced from the center of the face panel more toward the short side end than L/2.

3. A color cathode ray tube according to claim 1, wherein, at the inner surface of the face panel, the curvature radius in the long axis direction on the long axis has a minimal value at a position spaced from the center of the face panel more toward the long axis end side than L/2.

4. A color cathode ray tube according to claim 1, wherein the phosphor screen has phosphor layers and non-emitting black layers and a percentage of the non-emitting black layers per unit area at least in the neighborhood of a diagonal axis end of the face panel is equal to, or smaller than, a percentage of the non-emitting black layer per unit area at the center portion of the face panel.

5. A color cathode ray tube according to claim 1, wherein the transmittance of the center portion of the face panel is below 60%.

6. A color cathode ray tube according to claim 1, wherein the shadow mask includes a substantially rectangular mask body arranged opposite to the phosphor screen and having a large number of electron beam passage apertures, and a substantially rectangular mask frame supporting the peripheral edge of the mask body;

the mask body satisfies the following relations $$ZV<0.8ZD$$

$$ZH<0.8ZD$$

Where ZD represents a falling amount at a diagonal axis end of the mask body in the tube-axis direction relative to the height of a center of the mask body, ZV a falling amount at a short axis end, and ZH a falling amount at a long axis end; and the mask body is formed such that the curvature radius in the short axis direction on the long axis decreases from the center of the mask body toward a long axis end thereof and the curvature radius has a minimal value at a position spaced from the center of the mask body more toward the long axis end side than d/2, where d represents a distance from the center of the mask body to the long axis end, and the curvature radius in a long axis direction on the long axis has a minimal value at a position spaced from the center of the mask body more toward the long axis end side than d/2.

7. A color cathode ray tube according to claim 6, wherein, at an area between the center of the mask body and a portion spaced from the center of the mask body by d/2 toward the long axis end side, the curvature radius in a direction parallel to the short axis of the mask body is so set as to decrease from on the long axis toward a long side of the mask body.

8. A color picture tube apparatus comprising:

the color cathode ray tube according to claim 1;

a drive circuit for driving the electron gun of the color cathode ray tube; and a housing for holding the color cathode ray tube and drive circuit therein.

9. A color cathode ray tube comprising:

a vacuum envelope including a substantially rectangular face panel having a substantially flat outer surface and an inner surface with a phosphor screen formed thereon, short and long axes orthogonal to a tube axis and orthogonal to each other, a pair of long sides substantially parallel to the long axis and a pair of short sides substantially parallel to the short axis;

a shadow mask arranged within the vacuum envelope to face the phosphor screen; and an electron gun provided within the vacuum envelope, for emitting electron beams onto the phosphor screen through the shadow mask, wherein the thickness of the face panel is so formed as to be greater at a peripheral edge portion than at a center portion of the face panel, a curvature radius in the long axis direction on the long axis at the inner surface of the face panel has a minimal value at a positions paced from a center of the face panel more toward the long axis end side than L/2, provided that a distance from the center to the long axis end of the face panel is L, and the face panel satisfies the following relations $$TD<2.5TC$$

$$TV<2.0TC$$

$$TH<2.0TC$$

where

TC: the thickness of the face panel at the center portion;

TD: the thickness of the face panel at a diagonal axis effective dimension end;

TV: The thickness of the face panel at a short axis effective dimension end; and TH: the thickness of the face panel at a long axis effective dimension end.

10. A color cathode ray tube according to claim 9, wherein, at an area between the short axis and the short side of the face panel, a difference between the thickness on the long axis and that on the long side at a cross-section parallel to the short axis has a maximal value at a position spaced from the center of the face panel more toward the short side end than L/2.

11. A color cathode ray tube according to claim 9, wherein, at least at an area spaced from the center of the face panel by L/2 toward the long axis end side, the curvature radius in a direction parallel to the short axis at the inner surface of the face panel is so set as to decrease from on the long axis toward the long side.

12. A color cathode ray tube according to claim 9, wherein the phosphor screen has phosphor layers and non-emitting black layers and a percentage of the non-emitting black layers per unit area at least in the neighborhood of a diagonal axis end of the face panel is equal to, or smaller than, a percentage of the non-emitting black layer per unit area at the center portion of the face panel.

13. A color cathode ray tube according to claim 9, wherein the transmittance of the center portion of the face panel is below 60%.

14. A color cathode ray tube according to claim 9, wherein the shadow mask includes a substantially rectangular mask body arranged opposite to the phosphor screen and having a large number of electron beam passage apertures, and a substantially rectangular mask frame supporting the peripheral edge of the mask body;

the mask body satisfies the following relations $$ZV<0.8ZD$$

$$ZH<0.8ZD$$

where ZD represents a falling amount at a diagonal axis end of the mask body in the tube-axis direction relative to the height of a center of the mask body, ZV a falling amount at a short axis end, and ZH a falling amount at a long axis end; and the mask body is formed such that the curvature radius in the short axis direction on the long axis decreases from the center of the mask body toward a long axis end thereof and the curvature radius has a minimal value at a position spaced from the center of the mask body more toward the long axis end side than d/2, where d represents a distance from the center of the mask body to the long axis end, and the curvature radius in a long axis direction on the long axis has a minimal value at a position spaced from the center of the mask body more toward the long axis end side than d/2.

15. A color cathode ray tube according to claim 14, wherein, at an area between the center of the mask body and a portion spaced from the center of the mask body by d/2 toward the long axis end side, the curvature radius in a direction parallel to the short axis of the mask body is so set as to decrease from on the long axis toward a long side of the mask body.

16. A color picture tube apparatus comprising:

the color cathode ray tube according to claim 9;

a drive circuit for driving the electron gun of the color cathode ray tube; and a housing for holding the color cathode ray tube and drive circuit therein.

* * * * *